US009396899B2

(12) United States Patent
Sandoval Camacho et al.

(10) Patent No.: US 9,396,899 B2
(45) Date of Patent: Jul. 19, 2016

(54) METHODS AND APPARATUS FOR CALIBRATING A THERMOMAGNETIC TRIP UNIT OF A CIRCUIT BREAKER

(75) Inventors: Esteban Sandoval Camacho, Nuevo León (MX); Stephen Scott Thomas, Atlanta, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 14/370,992

(22) PCT Filed: Mar. 5, 2012

(86) PCT No.: PCT/US2012/027708
§ 371 (c)(1),
(2), (4) Date: Oct. 23, 2014

(87) PCT Pub. No.: WO2013/133787
PCT Pub. Date: Sep. 12, 2013

(65) Prior Publication Data
US 2015/0077200 A1 Mar. 19, 2015

(51) Int. Cl.

| | |
|---|---|
| ***H01H 75/10*** | (2006.01) |
| ***H01H 77/06*** | (2006.01) |
| ***H01H 81/04*** | (2006.01) |
| ***H01H 71/74*** | (2006.01) |
| ***H01H 73/36*** | (2006.01) |

(52) U.S. Cl.
CPC ..... *H01H 71/7463* (2013.01); *H01H 73/36* (2013.01)

(58) Field of Classification Search
CPC ..... H01H 73/36; H01H 71/7463
See application file for complete search history.

(56) References Cited

U.S. PATENT DOCUMENTS

| | | | | |
|---|---|---|---|---|
| 3,319,195 | A | 5/1967 | Brumfield | |
| 3,484,728 | A | 12/1969 | Shaffer | |
| 4,603,312 | A * | 7/1986 | Conner | 335/42 |
| 2005/0062568 | A1 | 3/2005 | Ciarcia | |

OTHER PUBLICATIONS

PCT International Search Report mailed Nov. 27, 2012 corresponding to PCT International Application No. PCT/US2012/027708 filed Mar. 5, 2012 (11 pages).

* cited by examiner

*Primary Examiner* — Bernard Rojas

(57) ABSTRACT

Methods, apparatus, and systems are provided for calibrating a thermomagnetic trip unit in a circuit breaker base assembly. An apparatus for calibrating a trip unit includes a calibration nut, an extended armature guide pin having a threaded portion, a spring disposed on the calibration nut and coiled around the extended armature guide pin, and an armature disposed on the spring and adapted to be held by an electromagnet. The calibration nut is threaded on the threaded portion of the extended armature guide pin and adapted to translate up or down depending on rotation of the extended armature guide pin to compress or decompress the spring against the armature. The extended armature guide pin includes a slotted end that is accessible when the apparatus is installed in the circuit breaker base assembly. The calibration nut is also accessible when the apparatus is installed in the circuit breaker base assembly.

20 Claims, 4 Drawing Sheets

METHODS AND APPARATUS FOR CALIBRATING A THERMOMAGNETIC TRIP UNIT OF A CIRCUIT BREAKER

FIELD OF THE INVENTION

The present invention generally relates to circuit breakers, and more particularly is directed to methods and apparatus for calibrating a thermomagnetic trip unit of a circuit breaker.

BACKGROUND OF THE INVENTION

Circuit breakers with thermomagnetic tripping means are well known in commercial and industrial applications. For example, U.S. Pat. No. 3,162,739 discloses a breaker which has a bimetallic strip element for thermal trip and an electromagnetic element for instantaneous trip. Thermomagnetic circuit breakers are commonly used in distribution panels to incorporate both techniques with the electromagnetic element responding instantaneously to large surges in current (e.g., short circuits) and the bimetallic strip element responding to less extreme, but longer-term over-current conditions. The thermal portion of the circuit breaker provides an "inverse time" response feature which provides faster or slower response for larger or smaller over currents respectively.

When a fault is detected (e.g., the breaker's current rating is exceeded), the electromagnet disposed around the load conductor attracts an armature linked to a tripbar which rotates to release stored energy within the trip unit which then trips a frame and opens the contacts to interrupt the circuit. Typically, in an electromagnet system, a spring is used to hold the armature until a sufficient in-rush of current occurs which creates a magnetic force in the electromagnet strong enough to compress the spring and pull the armature towards the electromagnet which trips the breaker. The initial length and force needed to compress the spring is calibrated to provide an amount of force sufficient to prevent movement of the armature until there is a large enough in-rush of current. Thus, what is needed are methods and apparatus for easily calibrating the thermomagnetic trip unit of a circuit breaker.

SUMMARY OF THE INVENTION

Inventive methods and apparatus are provided for calibrating a thermomagnetic trip unit. The invention provides an apparatus that includes a calibration nut, an extended armature guide pin having a threaded portion, a spring disposed on the calibration nut and coiled around the extended armature guide pin, and an armature disposed on the spring and adapted to be attracted by an electromagnet. The calibration nut is threaded onto the threaded portion of the extended armature guide pin and adapted to translate up or down, depending on rotation of the extended armature guide pin, to compress or decompress the spring against the armature. The extended armature guide pin includes a slotted end that is accessible during a manufacturing calibration process when the apparatus is installed in a lower housing of circuit breaker enclosure. The calibration nut is also accessible when the apparatus is installed in the lower housing of the circuit breaker enclosure. Once the trip unit is calibrated, an upper housing or top portion of the circuit breaker enclosure is installed to seal and electrically insulate the circuit breaker and trip unit.

In some other embodiments, a circuit breaker including an installed thermomagnetic trip unit adapted to be calibrated is provided. The circuit breaker includes a housing (having an upper portion and a lower portion) enclosing the circuit breaker and the thermomagnetic trip unit. The thermomagnetic trip unit is installed in the lower portion of the housing and includes a calibration nut, an extended armature guide pin having a threaded portion, a spring disposed on the calibration nut and coiled around the extended armature guide pin, and an armature disposed on the spring and adapted to be held by an electromagnet. The calibration nut is threaded onto the threaded portion of the extended armature guide pin and adapted to translate up or down depending on rotation of the extended armature guide pin to compress or decompress the spring against the armature. The extended armature guide pin includes a slotted end that is accessible when the apparatus is installed in the lower portion of the housing of the circuit breaker. The calibration nut is accessible when the apparatus is installed in the lower portion of the housing of the circuit breaker.

In yet other embodiments, a method of calibrating a thermomagnetic trip unit of a circuit breaker is provided. The method includes installing a thermomagnetic trip unit within a lower portion of a circuit breaker housing or base assembly of the circuit breaker. The thermomagnetic trip unit includes an accessible extended armature guide pin and an accessible calibration nut. The method further includes holding the calibration nut to prevent rotation but allowing translation along the extended armature guide pin and rotating the extended armature guide pin to cause the calibration nut to translate and compress a spring a desired amount. The extended armature guide pin includes a slotted end that is accessible when the apparatus is installed in the lower portion of a circuit breaker housing or base assembly of the circuit breaker. The calibration nut is accessible when the thermomagnetic trip unit is installed in the lower portion of a circuit breaker housing or base assembly of the circuit breaker.

Numerous other aspects are provided. Other features and aspects of the present invention will become more fully apparent from the following detailed description, the appended claims and the accompanying drawings.

DETAILED DESCRIPTION

The present invention provides improved methods and apparatus for easily calibrating the thermomagnetic trip unit of a circuit breaker. As discussed above, a spring within the trip unit of a breaker is used to hold an armature until sufficient in-rush current energizes an electromagnet enough to attract the armature by compressing the spring. The initial length and amount of force needed to compress the spring is calibrated to provide an amount of force sufficient to prevent movement of the armature until there is a large enough in-rush of current.

Figure 4:
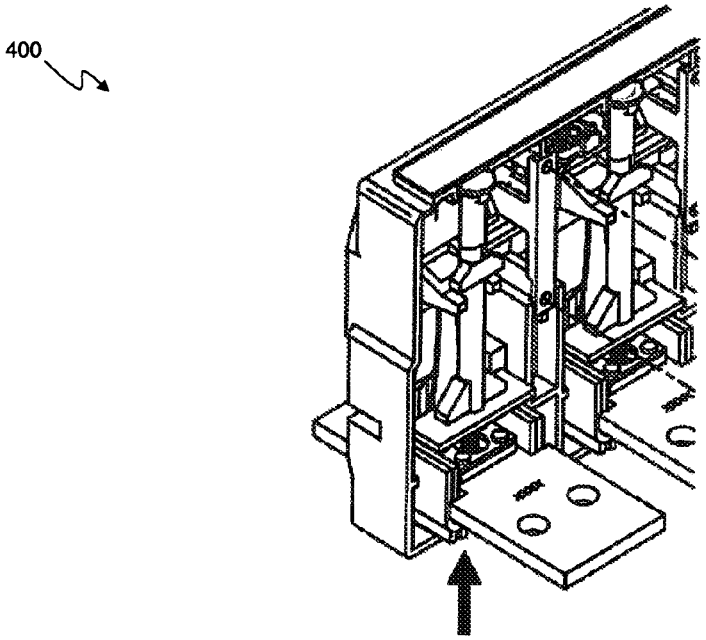
FIG. 4 (PRIOR ART)
FIG. 4 is a thermo-mechanical trip unit of a circuit breaker according to the prior art.

A rough, "cold" calibration may be performed during manufacturing before the trip unit is installed in the circuit breaker, but ideally, the length and initial spring force can be most accurately calibrated while installed in the circuit breaker. With currently existing circuit breaker trip units 400 as shown in FIG. 4, the mechanism for calibrating the spring is accessed via a hole in bottom of the trip unit housing indicated by the arrow. However, the location of this hole prevents the calibration mechanism of the spring of the trip unit from being accessible once the trip unit is installed in the circuit breaker. This is because the base assembly of the circuit breaker and the lower portion of the circuit breaker housing, within which the trip unit is installed, blocks the calibration access hole in the trip unit. Adding access holes to the circuit breaker housing is undesirable, as this would likely generate electrical insulation issues. Therefore, if a particular prior art thermomagnetic trip unit can be calibrated at all, existing trip units must either be calibrated in a special test/calibration fixture or be removed from the circuit breaker before the trip unit can be calibrated.

The present invention provides a thermomagnetic trip unit that can be calibrated while the trip unit is installed within the base of a circuit breaker housing. This provides a cost savings in manufacturing the circuit breaker because much simpler fixtures can be used to test and calibrate the trip unit. In addition, the trip unit can be calibrated for the actual frame (e.g., breaker base assembly) in which it will be sold. This improves accuracy of the calibration. In some embodiments, the circuit breaker includes a housing with an upper portion and a lower portion. The lower portion of the housing may include a base assembly of the circuit breaker.

A calibration nut threaded on an extended armature guide pin is used to adjust the length and initial force of the trip unit's spring which rests on the calibration nut. The extended armature guide pin includes a slotted end that extends up from the trip unit to allow adjustment of the position of the calibration nut.

Figure 1:
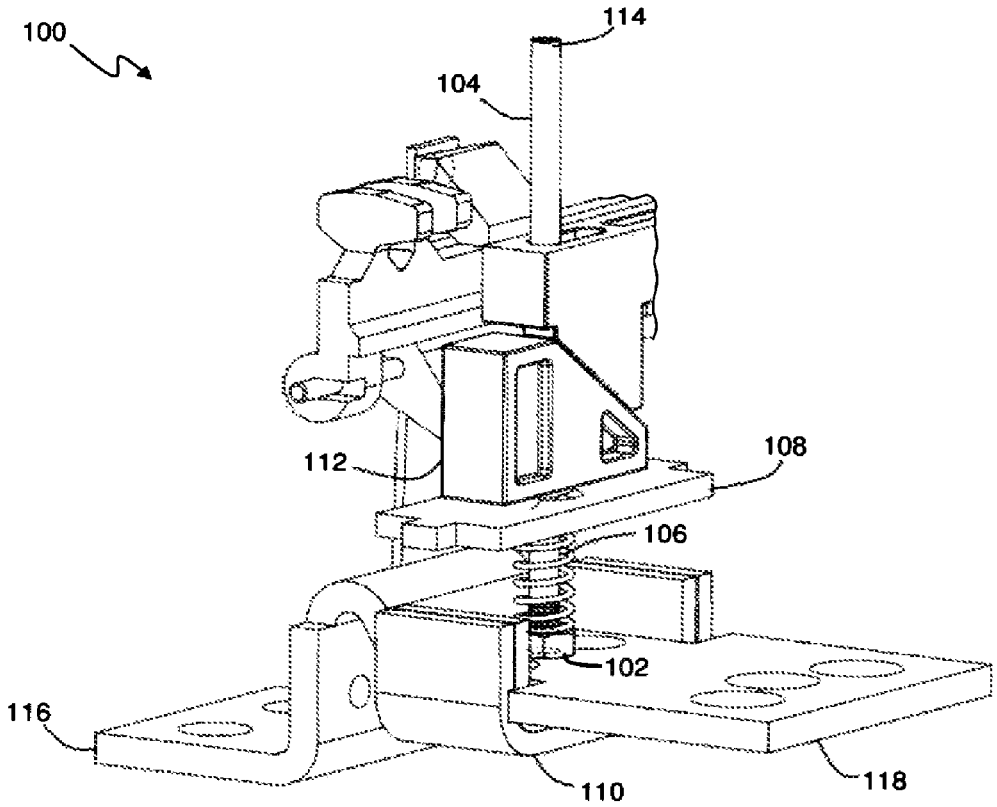
FIG. 1 is a diagram depicting a perspective view of an example thermomagnetic trip unit for a circuit breaker according to embodiments of the present invention.

Turning to FIG. 1, a perspective view of an example embodiment of a thermomagnetic trip unit 100 according to the present invention is depicted. A calibration nut 102 (e.g., a hex flange nut, a hex nut with a washer, or the like) is threaded on a threaded portion of an extended armature guide pin 104.

Resting on the calibration nut 102 and surrounding (i.e., coiled around) the extended armature guide pin 104, the spring 106 of the trip unit 100 is disposed so that the spring 106 is compressed as the calibration nut 102 is rotated up the threads of the extended armature guide pin 104. Thus, one end of the spring 106 contacts the calibration nut 102 while the other contacts the armature 108. As the spring 106 is compressed by translating the calibration nut 102 up the extended armature guide pin 104, the amount of upward force (i.e., from stored mechanical energy in the compressed spring 106) applied to the armature 108 is increased. Likewise, as the spring 106 is decompressed by translating the calibration nut 102 down the extended armature guide pin 104, the amount of upward force (i.e., from stored mechanical energy in the compressed spring 106) applied to the armature 108 is decreased.

In normal operation, the armature 108 is held up away from the electromagnet 110 via the spring 106. The electromagnet 110 forms a U-shape around the sides and bottom of the load conductor 116/load terminal 118 of the circuit breaker. The upward force of the spring 106 on the armature 108 is sufficient to prevent downward movement of the armature 108 until the magnetic force of the electromagnet 110 is sufficient to overcome the spring force and pull down the magnetically susceptible armature 108.

The magnetic force only reaches a level sufficient to overcome the spring force when the electric current flowing through the load conductor 116 rises to a level consistent with a fault event. Note that FIG. 1 depicts the trip unit 100 in a non-tripped state where the armature 108 has not been pulled down by the electromagnet 110 and the spring 106 is still holding up the armature 108. However, when an in-rush of current is at or above the desired trip level, the electromagnet 110 pulls the armature 108 down, the downward motion of the armature 108 lowers the armature locator 112 which causes a magnetic tripbar (not shown in FIG. 1 but see FIG. 2, 202) of the circuit breaker to be released which allows stored mechanical energy to open the breaker's contacts.

During calibration, the amount of initial force and length of the spring 106 may be adjusted by holding the calibration nut 102 stationary (rotationally) and rotating the extended armature guide pin 104 using slot 114. As the extended armature guide pin 104 is rotated with the calibration nut 102 being prevented from rotating, the calibration nut 102 translates up or down the extended armature guide pin 104 depending on the direction the extended armature guide pin 104 is rotated.

In some embodiments, for 800 amp to 1200 amp circuit breakers for example, the maximum travel amount that the calibration nut 102 may be adjusted may be approximately 4 mm. The threaded portion of the extended armature guide pin 104 may be approximately 20 mm. A slot 114 in the top end of the extended armature guide pin 104 is provided to facilitate rotation of the extended armature guide pin 104 using a tool such as, for example, a flathead screwdriver. The lower end of the extended armature guide pin 104 extends down through the load conductor 116/load terminal 118 and the electromagnet 110 and is fixed in a recess in a base unit 120 (see FIG. 2).

Figure 2:
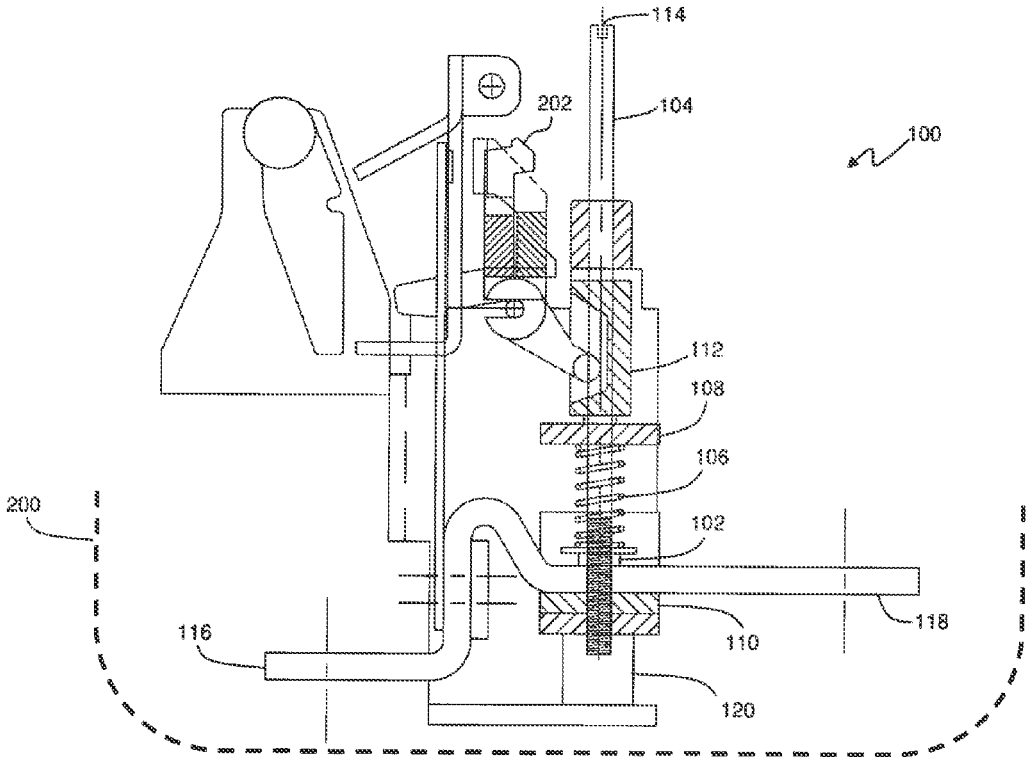
FIG. 2 is a schematic diagram depicting a cross-sectional side view of an example thermomagnetic trip unit installed in a lower housing of a circuit breaker according to embodiments of the present invention.

Turning now to FIG. 2, a more detailed schematic cross-sectional side view of an example embodiment of a thermomagnetic trip unit 100 is depicted within a lower housing 200 of a circuit breaker. The calibration nut 102 may be embodied as any adjustable fastener that can be selectively located on the threaded portion of the extended armature guide pin 104. The embodiment shown in FIG. 2 depicts a hex nut (calibration nut 102) on a partially threaded rod (extended armature guide pin 104). However, other fastener types and combinations (including washers) may be used including, for example, a locknut which resists movement once the nut has been set to the desired position.

In some embodiments, for an 800 amp to 1200 amp circuit breaker for example, an approximately M3.5×0.6 size nut may be used. Other size and type nuts may be used. The nut may be made of steel, brass, or any other suitable metal. The threaded portion of the extended armature guide pin 104 may have a diameter of approximately 3.5 mm and approximately M3.5×0.6 size threads. Other diameters and thread sizes may be used. The extended armature guide pin 104 may be made of steel, brass, or other suitable metal.

As described above, the spring 106 of the trip unit 100 is disposed so that the spring 106 is compressed as the calibration nut 102 is rotated up the threads of the extended armature guide pin 104. In some embodiments, for an 800 amp to 1200 amp circuit breaker for example, each full rotation of the calibration nut 102 relative to the extended armature guide pin 104 moves the calibration nut 102 approximately 0.6 mm and compresses or decompresses the spring 106 an equal amount. Other thread sizes with different displacements per rotation may be used. The use of smaller thread sizes can allow more precise adjustment of the amount of compression of the spring 106, and therefore, more precise calibration of the trip unit 100. In such embodiments, the spring 106 may be embodied as a coil compression spring. In some embodiments, for an 800 amp to 1200 amp circuit breaker for example, the spring 106 many have a total uncompressed length of approximately 35 mm, a fully compressed length of approximately 24 mm, a diameter of approximately 7 mm, and a wire size of approximately 0.8 mm. The spring 106 may be made of stainless steel, music wire, or other suitable metal. In some embodiments, for an 800 amp to 1200 amp circuit breaker for example, each full rotation of the calibration nut 102 relative to the extended armature guide pin 104 increases or decreases the amount of force exerted by the spring 106 by approximately 1.0 Newtons.

As with FIG. 1, FIG. 2 depicts a trip unit 100 in a non-tripped state. In the drawing shown, the armature 108 has not been pulled down by the electromagnet 110 and the spring 106 still supports the armature 108 above and apart from the electromagnet 110. However, if an in-rush of current sufficient to energize the electromagnet 110 enough to pull the armature 108 down does occur, the armature locator 112 coupled to the armature 108 moves down and trips the magnetic tripbar 202 which releases stored mechanical energy to open the breaker's contacts.

In FIG. 2, a lower housing 200 or base of the circuit breaker is represented by a dashed line. Along with the trip unit 100, this lower housing 200 contains operable portions of the circuit breaker such that operation of the trip unit installed in the lower housing can be tested and calibrated. Note that both the slot 114 in the end of the extended armature guide pin 104 and the calibration nut 102 can be accessed while the trip unit 100 is installed within the lower housing 200 of the circuit breaker. Also note that the bottom of the trip unit 100 is inaccessible from below when the trip unit 100 is installed in the lower housing 200. After the calibration of the trip unit 100 while installed in the lower housing 200 is completed, an upper housing (not shown) is installed to seal and insulate the circuit breaker.

Figure 3:
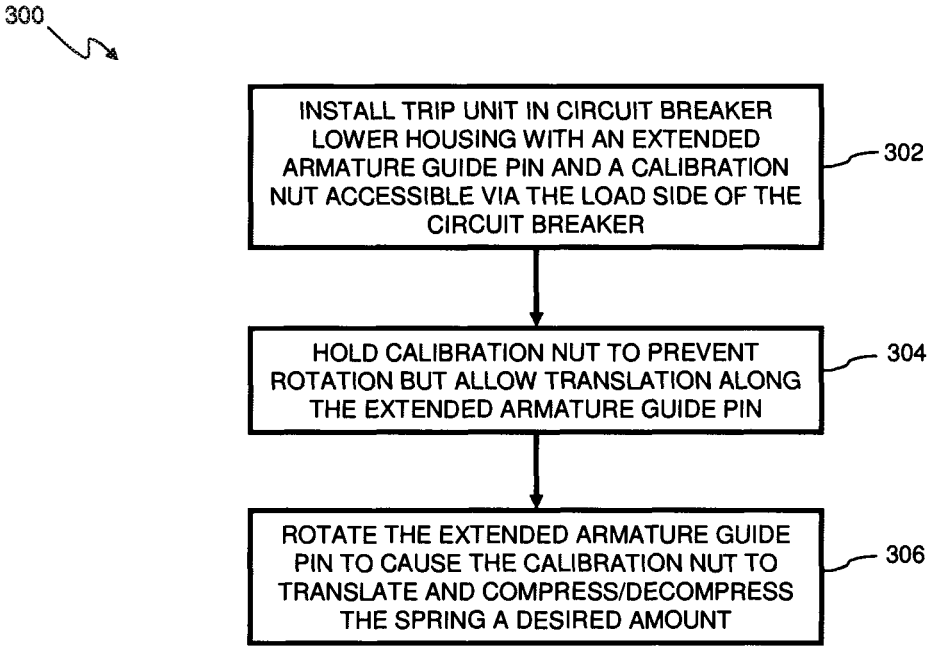
FIG. 3 is flowchart depicting an example method of calibrating a thermomagnetic trip unit for a circuit breaker according to embodiments of the present invention.

Turning now to FIG. 3, an example method 300 of calibrating an installed thermomagnetic trip unit 100 in a circuit breaker according to the present invention is depicted in a flowchart. In step 302, a trip unit 100 is installed within a lower housing of a circuit breaker including operable portions (e.g., a sub-assembly) of the circuit breaker. The trip unit 100 includes an extended armature guide pin 104 with a top end slotted portion (slot 116) that is accessible via the top of the circuit breaker and a calibration nut 102 that is accessible via the load side of the circuit breaker.

In step 304, the calibration nut 102 is held to prevent rotation but allowed to translate up or down the extended armature guide pin 104. In step 306, the extended armature guide pin 104 is rotated to cause the calibration nut 102 to translate up or down the extended armature guide pin 104 to position the calibration nut at a desired location. This compresses/decompresses the spring 106 to a desired length and applies a desired amount of initial force on the armature 108.

Accordingly, while the present invention has been disclosed in connection with the preferred embodiments thereof, it should be understood that other embodiments may fall within the spirit and scope of the invention, as defined by the following claims.

The invention claimed is:

1. An apparatus for calibrating a trip unit, the apparatus comprising:

a calibration nut;

an extended armature guide pin having a threaded portion;

a spring disposed on the calibration nut and coiled around the extended armature guide pin; and an armature disposed on the spring and adapted to be pulled by an electromagnet, wherein one end of the spring contacts the calibration nut while other end of the spring contacts the armature and wherein the calibration nut is directly accessible for calibration such that a length of the spring is adjusted by holding the calibration nut rotationally stationary and rotating the extended armature guided pin, wherein the calibration nut is threaded on the threaded portion of the extended armature guide pin and adapted to translate up or down depending on rotation of the extended armature guide pin to compress or decompress the spring against the armature.

2. The apparatus of claim 1 wherein the extended armature guide pin includes a slotted end that is accessible when the apparatus is installed in a lower housing of a circuit breaker.

3. The apparatus of claim 1 wherein the calibration nut is accessible when the apparatus is installed in a lower housing of a circuit breaker.

4. The apparatus of claim 3 wherein the calibration nut is adapted to be prevented from rotating as the extended armature guide pin is rotated.

5. The apparatus of claim 1 wherein the spring is adapted to prevent the armature from moving downward toward the electromagnet until a predefined amount of current flows through a circuit breaker.

6. The apparatus of claim 5 wherein movement of the armature downward causes a magnetic tripbar in the circuit breaker to trip.

7. The apparatus of claim 1 wherein the calibration nut includes a flange upon which the spring is disposed.

8. A circuit breaker including an installed thermomagnetic trip unit adapted to be calibrated, the circuit breaker comprising:

a housing enclosing the circuit breaker and the thermomagnetic trip unit, the housing including an upper portion and a lower portion, the thermomagnetic trip unit including:

a calibration nut;

an extended armature guide pin having a threaded portion;

a spring disposed on the calibration nut and coiled around the extended armature guide pin; and an armature disposed on the spring and adapted to be held by an electromagnet, wherein one end of the spring contacts the calibration nut while other end of the spring contacts the armature and wherein the calibration nut is directly accessible for calibration such that a length of the spring is adjusted by holding the calibration nut rotationally stationary and rotating the extended armature guided pin, wherein the calibration nut is threaded on the threaded portion of the extended armature guide pin and adapted to translate up or down depending on rotation of the extended armature guide pin to compress or decompress the spring against the armature.

9. The circuit breaker of claim 8 wherein the extended armature guide pin includes a slotted end that is accessible when the apparatus is installed in the lower portion of the housing of the circuit breaker.

10. The circuit breaker of claim 8 wherein the calibration nut is accessible when the apparatus is installed in the lower portion of the housing of the circuit breaker.

11. The circuit breaker of claim 10 wherein the calibration nut is adapted to be prevented from rotating as the extended armature guide pin is rotated.

12. The circuit breaker of claim 8 wherein the spring is adapted to prevent the armature from moving downward toward the electromagnet until a predefined amount of current flows through the circuit breaker.

13. The circuit breaker of claim 12 wherein movement of the armature downward causes a magnetic tripbar in the circuit breaker to trip.

14. The circuit breaker of claim 8 wherein the calibration nut includes a flange upon which the spring is disposed.

15. A method of calibrating a thermomagnetic trip unit of a circuit breaker, the method comprising:

installing a thermomagnetic trip unit within a circuit breaker base assembly wherein the thermomagnetic trip unit includes an accessible extended armature guide pin and an accessible calibration nut;

holding the calibration nut to prevent rotation but allowing translation along the extended armature guide pin; and rotating the extended armature guide pin to cause the calibration nut to translate and compress a spring a desired amount, wherein one end of the spring contacts the calibration nut while other end of the spring contacts an armature and wherein the calibration nut is directly accessible for calibration such that a length of the spring is adjusted by holding the calibration nut rotationally stationary and rotating the extended armature guided pin.

16. The method of claim 15 wherein the extended armature guide pin includes a slotted end that is accessible when the apparatus is installed in the circuit breaker base assembly.

17. The method of claim 15 wherein the calibration nut is accessible when the thermomagnetic trip unit is installed in the circuit breaker base assembly.

18. The method of claim 15 wherein the spring is adapted to prevent the armature from moving downward toward the electromagnet until a predefined amount of current flows through the circuit breaker.

19. The method of claim 15 wherein movement of the armature downward causes a magnetic tripbar in the circuit breaker to trip.

20. The method of claim 15 wherein the calibration nut includes a flange upon which the spring is disposed.

* * * * *